US007819123B2

(12) United States Patent
Zimmermann et al.

(10) Patent No.: US 7,819,123 B2
(45) Date of Patent: Oct. 26, 2010

(54) PROCESS AND APPARATUS FOR APPLYING PALLADIUM SALTS TO TOBACCO FILLER

(75) Inventors: Stephen G. Zimmermann, Midlothian, VA (US); James D. Baggett, Jr., Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 684 days.

(21) Appl. No.: 11/804,515

(22) Filed: May 18, 2007

(65) Prior Publication Data

US 2007/0295344 A1 Dec. 27, 2007

Related U.S. Application Data

(60) Provisional application No. 60/816,524, filed on Jun. 26, 2006.

(51) Int. Cl.
*A24B 15/28* (2006.01)

(52) U.S. Cl. ..... 131/309; 131/334

(58) Field of Classification Search ..... 131/334, 131/309

See application file for complete search history.

(56) References Cited

U.S. PATENT DOCUMENTS

| | | | | |
|---|---|---|---|---|
| 4,055,191 | A * | 10/1977 | Norman et al. | 131/334 |
| 4,177,822 | A | 12/1979 | Bryant, Jr. et al. | |
| 4,216,784 | A | 8/1980 | Norman et al. | |
| 4,235,251 | A | 11/1980 | Bryant, Jr. et al. | |
| 4,248,251 | A | 2/1981 | Bryant, Jr. et al. | |
| 4,257,430 | A | 3/1981 | Collins et al. | |
| 6,789,548 | B2 | 9/2004 | Bereman | |
| 2004/0163659 | A1 | 8/2004 | Sherron et al. | |
| 2005/0061338 | A1 | 3/2005 | Olegario et al. | |
| 2005/0121045 | A1 * | 6/2005 | Finlay et al. | 131/334 |
| 2006/0037621 | A1 | 2/2006 | Bereman et al. | |

FOREIGN PATENT DOCUMENTS

| | | |
|---|---|---|
| EP | 0419188 | 3/1991 |
| EP | 1269869 | 1/2003 |
| GB | 841074 | 7/1960 |
| GB | 1560804 | 2/1980 |

OTHER PUBLICATIONS

Gross et al, Thermal Decomposition of Palladium Acetate, Journal of Thermal Analysis, vol. 31, 1986, pp. 1231-1241.*

* cited by examiner

*Primary Examiner*—Carlos Lopez
(74) *Attorney, Agent, or Firm*—Connolly Bove Lodge & Hutz LLP

(57) ABSTRACT

An apparatus and method for the process of applying palladium salts to tobacco cut filler and other smokable products so that polycyclic aromatic hydrocarbons (PAHs) can be reduced in both mainstream (MS) and sidestream (SS) cigarette smoke. The reduction in PAHs is observed in the total particulate matter (TPM) of the mainstream (MS) and sidestream (SS) smoke. Additionally, substantial reductions in heavy metals and Ames biological activity can be achieved when the palladium salt solution is applied and processed in accordance with the present invention. The present invention provides these improvements by using a preferred ratio of palladium (Pd) salt to Chloride (Cl) that is specifically designed to allow for high palladium solubility. Further, the present invention provides an apparatus and method for applying the palladium salt solution while minimizing the number of processing steps required.

8 Claims, 7 Drawing Sheets

Filler pH Level:

PROCESS AND APPARATUS FOR APPLYING PALLADIUM SALTS TO TOBACCO FILLER

CROSS REFERENCE TO RELATED APPLICATION

The present application claims the benefit of provisional application Ser. No. 60/816,524, filed Jun. 26, 2006, for all useful purposes, and the specification and drawings thereof are included herein by reference.

FIELD OF THE INVENTION

The present invention relates to smokable products, such as cigarettes, and in particular to methods and processes that reduce the content of certain harmful or carcinogenic substances, including polycyclic aromatic hydrocarbons (PAHs), especially benzo[a]pyrene (BaP) in both mainstream smoke (MS) and side stream smoke (SS).

BACKGROUND OF THE INVENTION

Smokable products, such as cigarettes and tobacco, contain carcinogenic compounds including polycyclic aromatic hydrocarbons (PAHs). Finding approaches to reduce the levels of these carcinogenic compounds has long been a goal in this technical art.

One approach to removing undesired components from cigarettes and tobacco smoke is the use of catalysts. Palladium catalyst systems have been proposed for cigarettes. Examples of background art in this technical area include the following U.S. patents: U.S. Pat. No. 4,257,430 to Collins et al.; U.S. Pat. No. 4,248,251 to Bryant et al.; U.S. Pat. No. 4,235,251 to Bryant et al.; U.S. Pat. No. 4,216,784 to Norman et al.; U.S. Pat. No. 4,177,822 to Bryant et al.; and U.S. Pat. No. 4,055,191 to Norman et al., each of which is incorporated by reference in its entirety. These early attempts at incorporating catalytic systems into mass-produced cigarettes have met with limited success. Therefore, there is a need in the art for a catalytic system that reduces the levels of certain carcinogenic or otherwise undesirable components from tobacco smoke, and which is amenable to use in mass-produced cigarettes, is desirable.

A more recent example of background art in this technical area is U.S. Pat. No. 6,789,548 to Bereman et al., which relates to a method for making a composition for smokable materials in general and in particular to catalytic systems that reduce the content of certain harmful or carcinogenic substances. Specifically, Bereman et al. discloses palladate salts, especially ammonium salts such as ammonium tetrachloropalladate and ammonium hexachloropalladate. In fact, many other background art approaches in this art area use hexachloropalladate forms which typically require high levels of Chloride and high pH solutions. Typically, these higher pH solutions are needed in order to achieve high solubility for the palladium. However, such high pH hexachloropalladate solutions can have dramatic negative effects on equipment and/or required additional steps be added to the process.

Further, Bereman et al. discloses that, on preferred embodiments, a catalyst system including catalytic metallic and/or carbonaceous particles and a nitrate or nitrite source is incorporated into the smokable materials so as to reduce the concentration of certain undesirable components in the resulting smoke (e.g., PAHs). Other background art approaches also require the use of nitrate to achieve their required reductions in PAHs.

Furthermore, Bereman discloses in embodiments wherein the particles are metallic; the particles are preferably prepared by heating an aqueous solution of a metal ion source and a reducing agent. Other previous patents have required the heating be between 50 and 90 degrees C. in order to aid in converting most of the soluble palladium to insoluble palladium. The additional requirements of adding nitrate/nitrite and heating, as discussed above, are examples of steps that are added to the process for treating smokable materials in the background art.

Therefore, there is a need in the art for an apparatus and method for application of palladium salts to smokable materials without the detrimental effects of high pH and additional preparation or processing steps often required with background art concentrations of hexachloropalladate. In addition, there is a need in the art for a method where no nitrate materials are required in order to achieve the necessary PAH reductions. Further, there is a need in the art for a palladium salt solution that can be applied without any additional heat requirements in order to convert soluble palladium into insoluble palladium. Furthermore, there is a need in the art for a Pd Salt solution that does not need to be mixed with other solvents or casings to achieve the desired affects. That is, so the normal tobacco casings and flavors can be processed separately and so that no catalytic effects are created due to these components.

SUMMARY OF THE INVENTION

The present invention provides improvements to apparatus and methods for the process of applying palladium salts to tobacco cut filler so that polycyclic aromatic hydrocarbons (PAHs) can be reduced in both mainstream (MS) and sidestream (SS) cigarette smoke. The reduction in PAHs is observed in the total particulate matter (TPM) of the mainstream (MS) and sidestream (SS) smoke. Additionally, substantial reductions in heavy metals and Ames biological activity can be achieved when the palladium salt solution is applied and processed in accordance with the present invention. The present invention provides these improvements by using a preferred ratio of palladium (Pd) salt to Chloride (Cl) that is specifically designed to allow for high palladium solubility. Further, the present invention provides an apparatus and method for applying the palladium salt solution while minimizing the number of processing steps required. Moreover, the present invention avoids any potential increase in Nitric Oxide (NO) in smoke since nitrate is not used.

One embodiment of the present invention is an apparatus for applying a Pd salt solution comprising: a cutter unit; a feeder unit; a Pd Salt Solution Preparation Unit; a Pd Application Cylinder; a dryer; and a Final Flavoring cylinder, wherein the cutter unit receives and prepares tobacco cut filler; the feeder unit receives and feeds the tobacco cut filler from the cutter unit to the Pd Salt Solution Application Cylinder, the Pd Salt Solution Application Cylinder receives and sprays the tobacco cut filler with a metered Pd Salt solution from the Pd Salt Solution Preparation unit, the dryer unit receives and dries sprayed tobacco cut filler from the Pd Application Cylinder, and the Final Flavoring Cylinder receives dried tobacco cut filler from the dryer unit.

Preferably the Pd Application Cylinder is a rotating cylinder that allows tobacco cut filler to enter with some residence time such that a set of spray nozzles can apply Pd Solution to the tobacco cut filler. Further, preferably the Final Flavoring Cylinder is a rotating cylinder that allows tobacco cut filler to enter with some residence time such that a set of spray nozzles can apply final flavoring to the tobacco cut filler.

In addition, a preferred embodiment of the Pd Salt Solution Preparation unit further comprises a Pd Salt Solution Source, a Pd Concentration Metering Unit; a Pd De-ionized Water Source; a De-ionized Water Metering Unit; a Pd Salt Solution Tank; and a Pd Salt Solution metering unit, wherein the Pd Concentration Metering Unit and the De-ionized Water Metering Unit are configured to provide metered amounts of the Pd Salt Solution Source and the De-ionized Water Source, respectively, as inputs to the Pd Solution Tank, and the Pd Salt solution Metering Unit is configured to provide the metered Pd Salt solution to the Pd Application Cylinder.

Preferably the Pd Concentration Metering Unit is a volumetric feeding system that is based on a ratio of De-ionized water-to-Pd Solution. Further, the De-ionized Water Metering Unit is preferably a volumetric flowmeter that ensures the proper ratio of de-ionized water-to-Pd Solution. A non-limiting example of such a unit is a turbine flowmeter. Preferably, the Pd Solution Tank is made of plastic or other similar materials (e.g., metals such as Hastelloy 'C') and includes means for agitating. Non-limiting example of plastic would be polypropylene and means for agitating would include but are not limited to a mixer, stirrer and other well known means for mixing/agitating a solution. Preferably the Pd Salt Solution metering unit is a mass flow meter that applies the correct amount of Pd Solution depending on flowrate of tobacco cut filler entering the Pd Application Cylinder.

Another embodiment of the present invention is a method for applying the palladium salt solution comprising: preparing tobacco cut filler; feeding the tobacco cut filler to a Pd Application Cylinder; metering an amount of Pd Salt solution from a Pd Salt Solution tank; spraying the tobacco cut filler with the metered amount of Pd Salt Solution in a Pd Application Cylinder; and other, drying the sprayed tobacco cut filler in a drying unit; and processing the dried tobacco cut filler. Non-limiting examples of standard drying techniques include, but are not limited to, rotating a cylinder or drum as hot air passes through the cylinder or drum; and drive off water or other liquids from tobacco cut filler until you reach a desired degree of dryness.

Preferably, the present invention uses filler that can be wetted with the palladium solution starting with tobacco cut filler at 12% oven volatiles (OVs) up to and including 45% OV, depending on the level of palladium required in the final tobacco filler. This range of OVs gives great latitude in achieving the proper percentage of palladium in the final tobacco filler. Preferably, the concentration for palladium salts relative to tobacco weight is between 0.01% and 0.15%.

Preferably, the present invention uses palladium (Pd) in the form of tetracholorpalladate along with salts that include, but are not limited to, potassium, ammonia and sodium. In particular, examples using potassium tetrachloropalladate are presented below. The present invention maintains a proper ratio of chlorine (Cl)-to-palladium (Pd) (i.e., Cl:Pd) by maintaining a proper solution pH and achieves >99% palladium solubility. This ratio of Cl:Pd not only provides extremely high palladium solubility but also provides extended shelf life without any precipitation.

In examples given below, testing showed that extended use of tetrachloropalladate solutions caused pitting and damage to industry standard stainless steel cylinder and wetted parts. This is due to the fact that the chloride content in the solution attacks the chromium in the stainless steel. Other metals such as inconel and monel also show similar behavior. In addition, Hastelloy 'C' was used for all metal wetted parts.

The apparatus and method of the present invention allows the palladium salt solution to be applied without any additional solution preparation. Despite the pH of the solution (i.e., in the range of 2.5-4.5) being fairly acidic, application and processing of smoking materials with the palladium solution of the present invention: (1) does not show any increase in overall tobacco pH; (2) does not affect the level of reducing sugars; and (3) does not negatively affect previously added casings or downstream flavor addition. Moreover, the apparatus and method for applying the palladium solution of the present invention in a separate step from casing addition requires no other additional processing steps.

BRIEF DESCRIPTION OF THE DRAWINGS

The invention can be described in greater detail with the aid of the following drawings.

DETAILED DESCRIPTION OF THE PREFERRED EMBODIMENT

Figure 1:
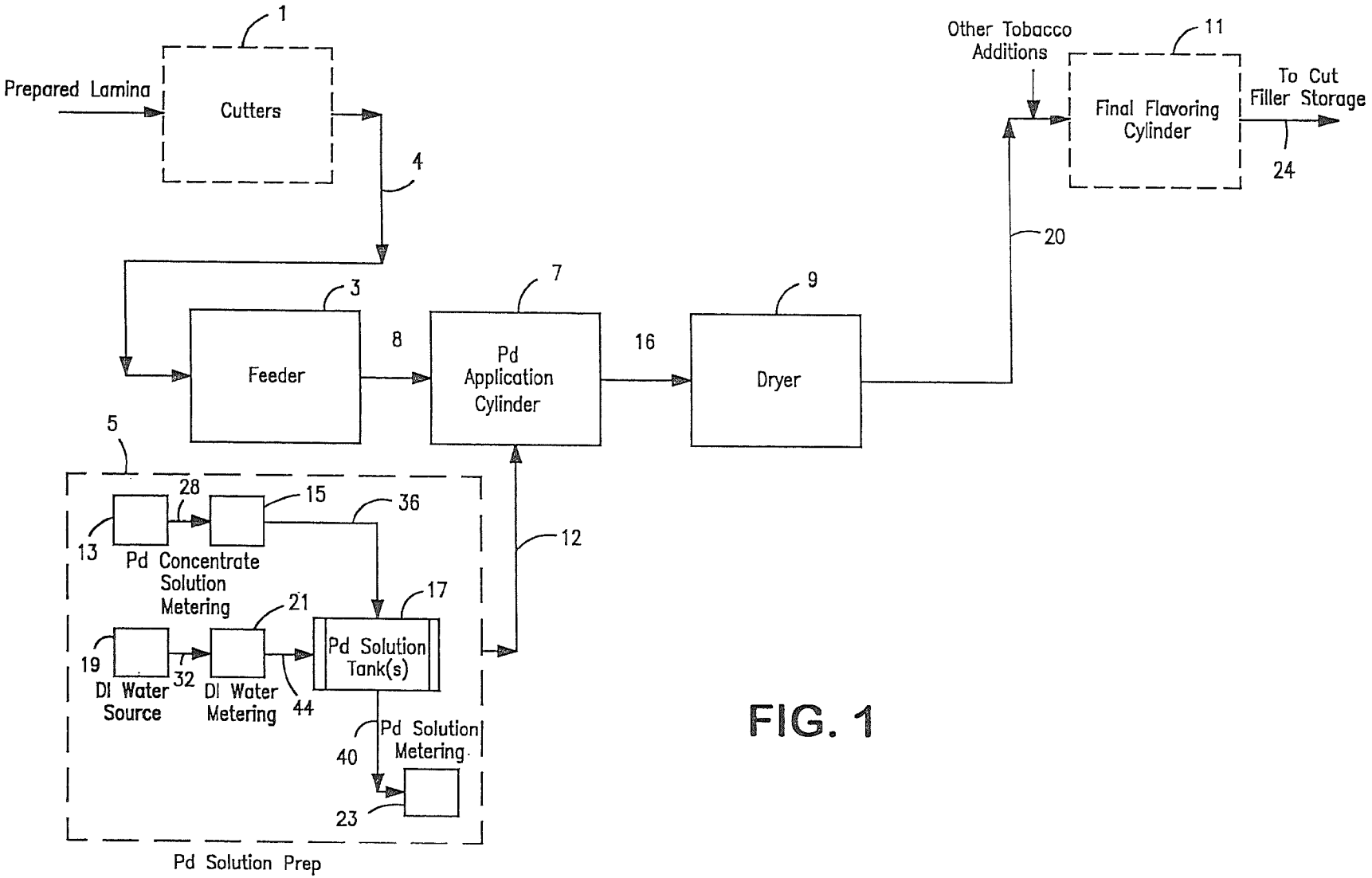
FIG. 1 is an exemplary block diagram showing the functional blocks used to implement the apparatus of the present invention.

The exemplary system block diagram of FIG. 1 shows the apparatus of the present invention. In particular, FIG. 1 presents an apparatus for application comprising a cutter unit 1; a feeder unit 3; a Pd Salt Solution Preparation Unit 5; a Pd Application Cylinder 7; a dryer unit 9; and a Final Flavoring Cylinder 11. As shown in FIG. 1, the cutter unit 1 receives and a cut prepared filler and is connected to the feeder unit 3. The feeder unit 3 receives tobacco cut filler 4 from the cutter unit 1 and feeds filler 8 to the Pd Salt Solution Application Cylinder 7. The Pd Salt Solution Application Cylinder 7 receives filler 8 from the feed unit 3 and sprays the filler 8 with a metered Pd Salt solution 12 from the Pd Salt Solution Preparation unit 5. The dryer unit 9 receives sprayed filler 16 from the Pd Salt Solution Application Cylinder 7 and dries the sprayed filler 16. The Final Flavoring Cylinder 11 receives the dried filler 20 from the dryer unit 9 and sprays final flavor on filler 24 and sends to processed tobacco cut filler storage.

As discussed above, the metered Pd salt solution 12 is applied to the filler 8 in the Pd Application Cylinder 7. A metered Pd Salt solution 12 can be provided at the time of application by the Pd Application Cylinder 7 from the Pd Solution Tank(s) 17 of the Pd Salt Solution Preparation Unit 5, as shown in FIG. 1.

Alternatively, as shown in FIG. 1, the Pd Salt Solution 12 can be made ahead of time as a concentrated Pd Salt solution 28 supplied by a concentrated Pd Salt Source 13. The amount of concentrated Pd Salt Solution 28 is determined by a Pd Concentration Metering Unit 15 connected to the concentrated Pd Salt Source 13. The metered concentrated Pd Salt Solution 36 is provided to the Pd Salt Solution Tank(s) 17. The concentration of the concentrated Pd Salt Solution 36 can be diluted further to provide a predetermined concentration of Pd Salt Solution 12 with De-ionized water 32 supplied from a De-ionized Water Source 19. The amount of De-ionized water 32 provided to the Pd Salt Solution Tank(s) 17 is metered by a De-ionized Water Metering Unit 21. A Pd Salt Solution Metering Unit 23 provides a predetermined concentration of Pd Salt Solution 40 as the metered Pd Salt Solution 12 that is received by the Pd Application Cylinder 7 for spraying onto the tobacco cut filler 8.

Figure 2:
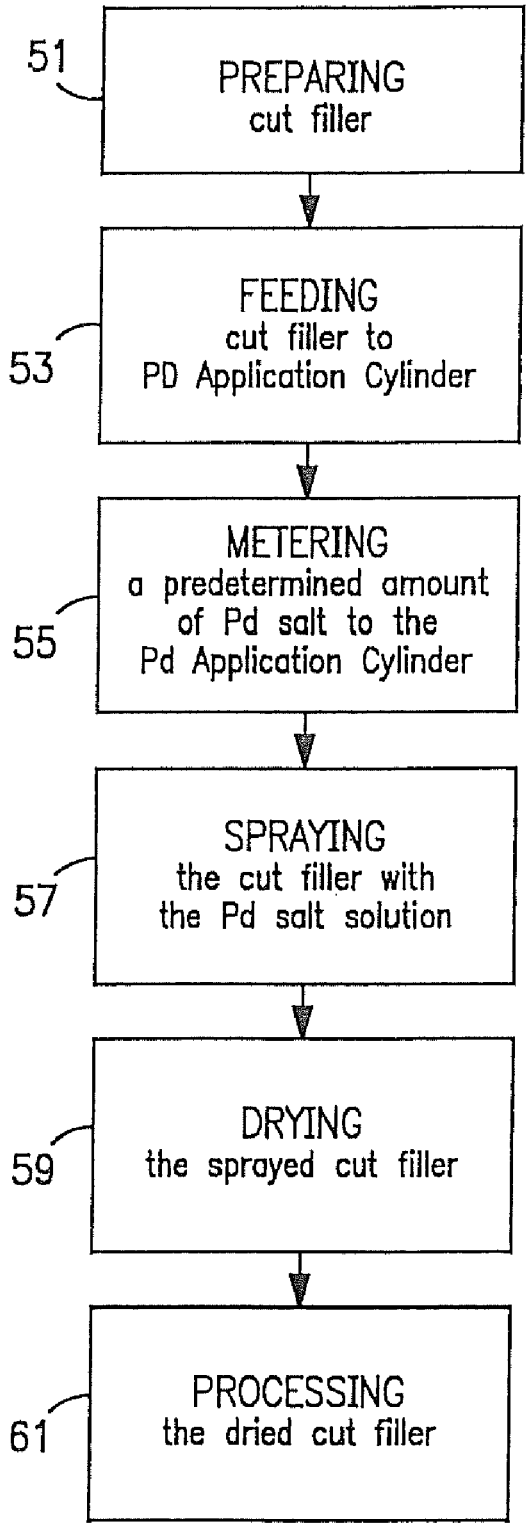
FIG. 2 is an exemplary flow diagram presenting the method of the present invention.

FIG. 2 is an exemplary flow diagram presenting the method of the present invention. In particular, FIG. 2 shows a method for applying a palladium salt solution where step 51 is preparing tobacco cut filler. In step 53 of FIG. 2, the tobacco cut filler is fed to a Pd Application Cylinder. Metering an amount of Pd Salt solution from a Pd Salt Solution tank occurs in step 55 of FIG. 2 and spraying the tobacco cut filler with the metered amount of Pd Salt Solution occurs in a Pd Application Cylinder in step 57. The sprayed tobacco cut filler is dried in a drying unit in step 59. Finally, further processing of the dried tobacco cut filler is performed in step 61, as shown in FIG. 2.

EXAMPLES

Figure 3:
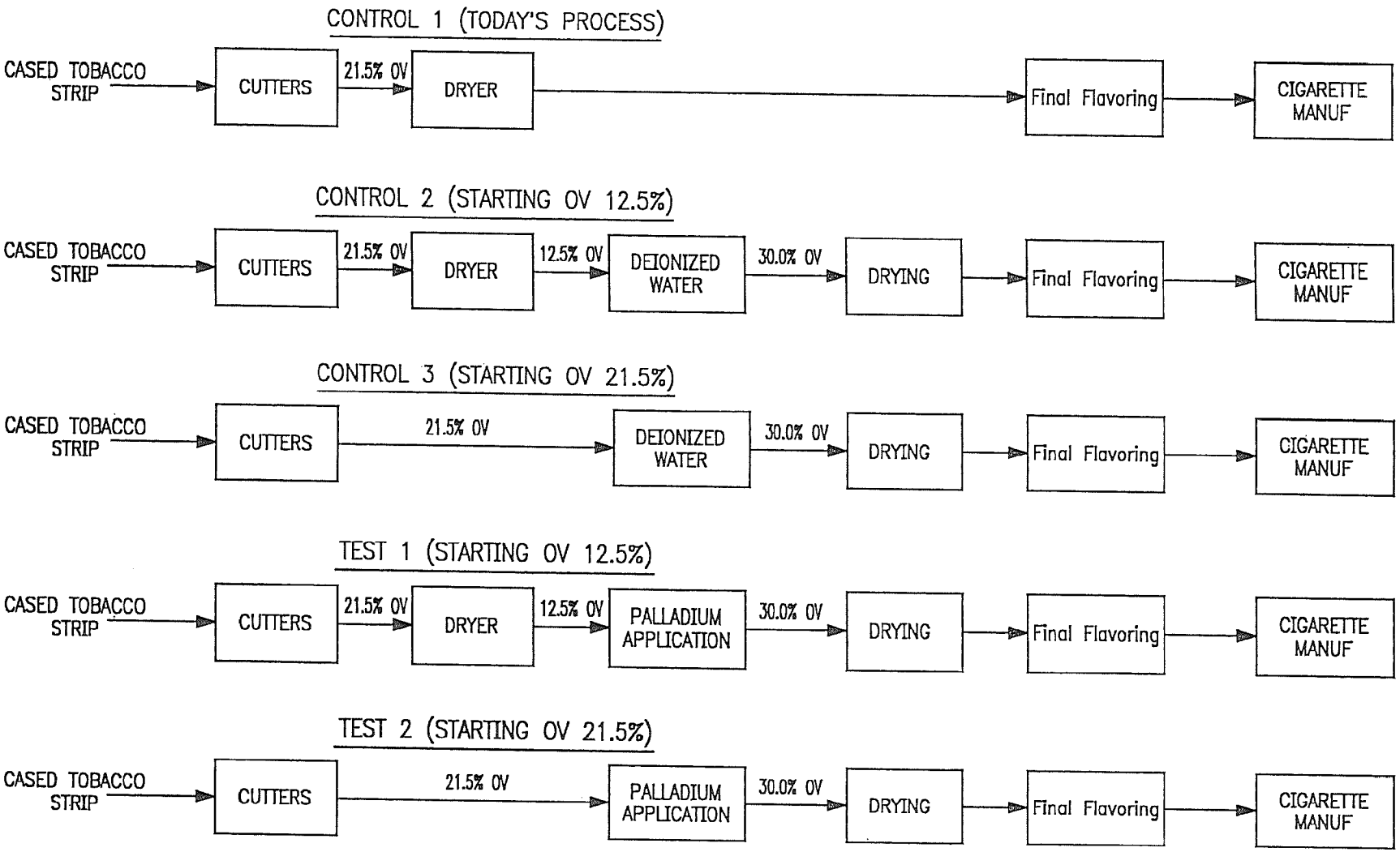
FIG. 3 is a exemplary block diagram of the testing sequences used in a Palladium Application Study.

The following example test results are provided to experimentally verify the performance of the present invention. As shown in FIG. 3, five different test runs were made for a Palladium Application study. Each trial used standard tobacco cut filler. The first run, as shown in the "Control 1" example of FIG. 3, was processed as normal using standard casings, flavors and targets. The next series of tests, as shown in "Control 2," "Control 3," "Test 1," and "Test 2" examples of FIG. 3, were planned to determine what starting OV was needed for application of palladium solution in order to achieve the best possible reductions in PAH's. The different starting OV's of the tobacco cut filler used were 12.5% and 21.5%. In each case either de-ionized water (i.e., see "Control 2" and "Control 3" of FIG. 3) or palladium solution (i.e., see "Test 1" and "Test 2" of FIG. 3) were applied. The amount of palladium in solution was designed so that the final filler target of 750 ppm was achieved. The difference between how the two different starting OV's were processed required that the filler be dried down to 12.5% (i.e., see "Control 2" and "Test 1" of FIG. 3) from its normal exit cutter OV of 21.5%. Therefore, additional handling and processing was required in order to complete the testing using a starting OV of 12.5%.

Following the first standard control test, two control tests (i.e., "Control 2" and "Control 3" of FIG. 3) were run with de-ionized water applied to the tobacco cut filler at a starting OV of 12.5% and 21.5%, respectively. Finally, two palladium application tests (i.e., "Test 1" and "Test 2" of FIG. 3) were run at the different starting OV's. For each of the two tests using de-ionized water and the two tests with palladium solution the moisture of the tobacco cut filler exiting the application cylinder was measured to be around 30%.

Figure 4:
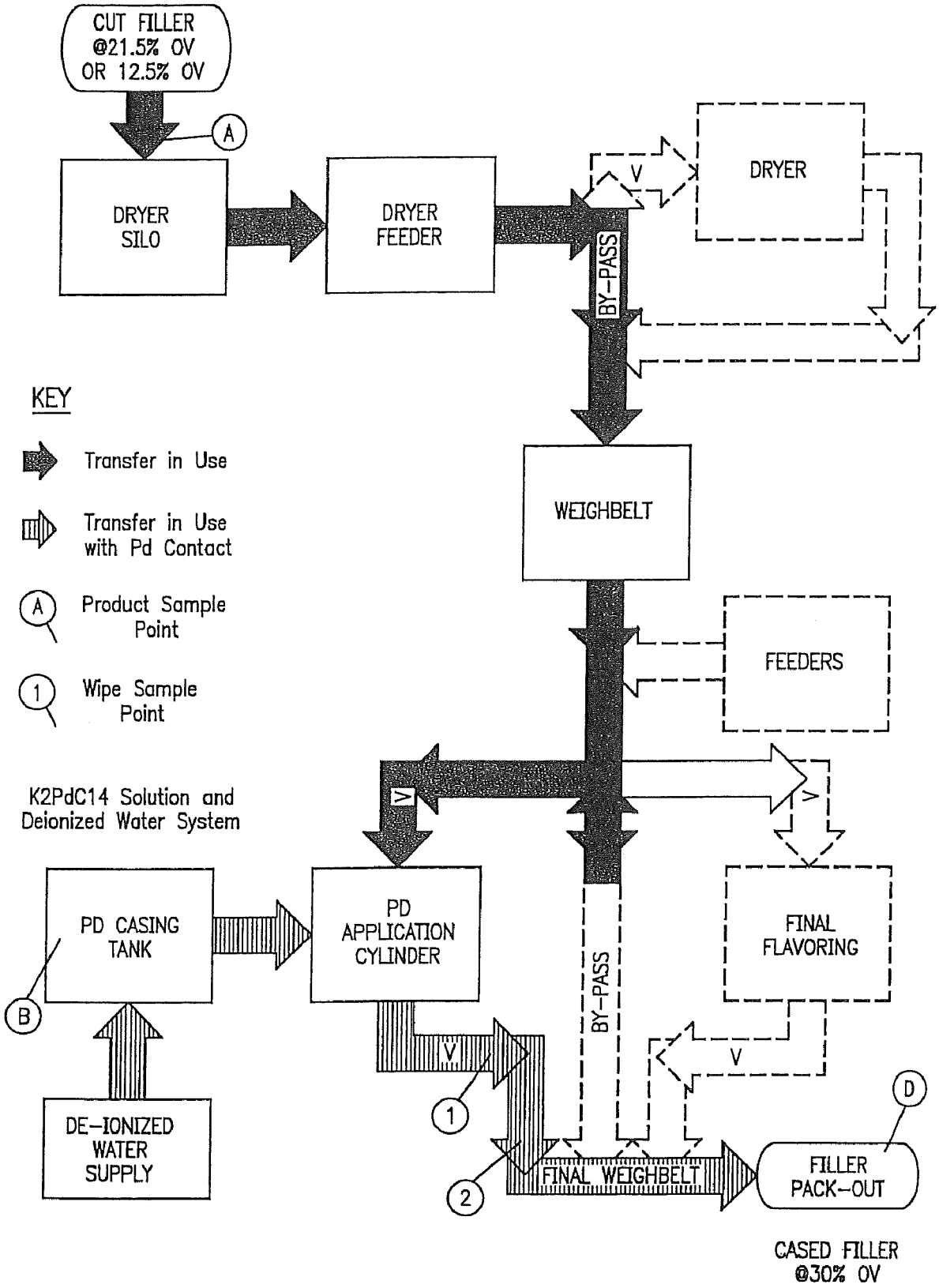
FIG. 4 is an exemplary block diagram for the Casing Train measurement.

FIG. 4 is an exemplary flow diagram for the method of casing train measurement. The palladium solution used was a concentrated potassium tetrachloropalladate (K2PdC14) as indicated at the Pd Casing Tank of FIG. 4. The concentration of the solution was diluted with de-ionized water. The amount of dilution depends on the concentration of Pd in the initial solution that is required to achieve a final Pd filler target of 750 ppm. This high exiting OV required that the filler be dried down to proper levels prior to final processing. Samples were taken at several key points in the process as indicated by references A, 1 of FIG. 4. In addition, references B and D refer to locations used for sampling filler to be analyzed. Further, reference 2 refers to sample points where wipe samples were taken. This included Exit Cutter, Exit Dryer (1st pass), Exit Final Weighbelt (1st pass), Exit Dryer (2nd pass) and Exit Final Weighbelt (2nd pass).

An explanation is required regarding the sample locations A, 1 of FIG. 4 for the different tests. Since the first standard control test was processed under normal conditions the sampling locations were Exit Cutter ($1^{st}$ pass), Exit Dryer ($1^{st}$ pass) and Exit Final Weighbelt ($1^{st}$ pass). For the tests using a starting OV of 12.5%, the sampling locations were Exit Cutter, Exit Dryer ($1^{st}$ pass), Exit Final Weighbelt ($1^{st}$ pass), Exit Dryer ($2^{nd}$ pass) and Exit Final Weighbelt ($2^{nd}$ pass). For the tests using a starting OV of 21.5%, the sampling locations were Exit Cutter, Exit Final Weighbelt ($1^{st}$ pass), Exit Dryer ($2^{nd}$ pass) and Exit Final Weighbelt ($2^{nd}$ pass). Therefore, for comparison purposes, the Exit Dryer ($1^{st}$ pass) for the first standard control test and the Exit Dryer ($2^{nd}$ pass) for all the other runs are equivalent.

In general, filler samples were tested for a variety of constituents. The filler was tested for levels of Pd, pH, PG, Glycerin, Total reducing sugars, Glycyrrhizic acid, Theobromine, Total alkaloids, Sugars (individual-fructose, glucose and sucrose), Nitrate Nitrogen, Phosphorus, Soluble Ammonia, TSNA's and OV's. All results are displayed on a dry weight basis. Cigarettes were made from the filler from each run. The cigarettes were tested for PAHs, TSNAs, Phenols, VOCs, and Carbonyls. All data was put on a per mg/Tar (FTC) basis.

Figure 5:
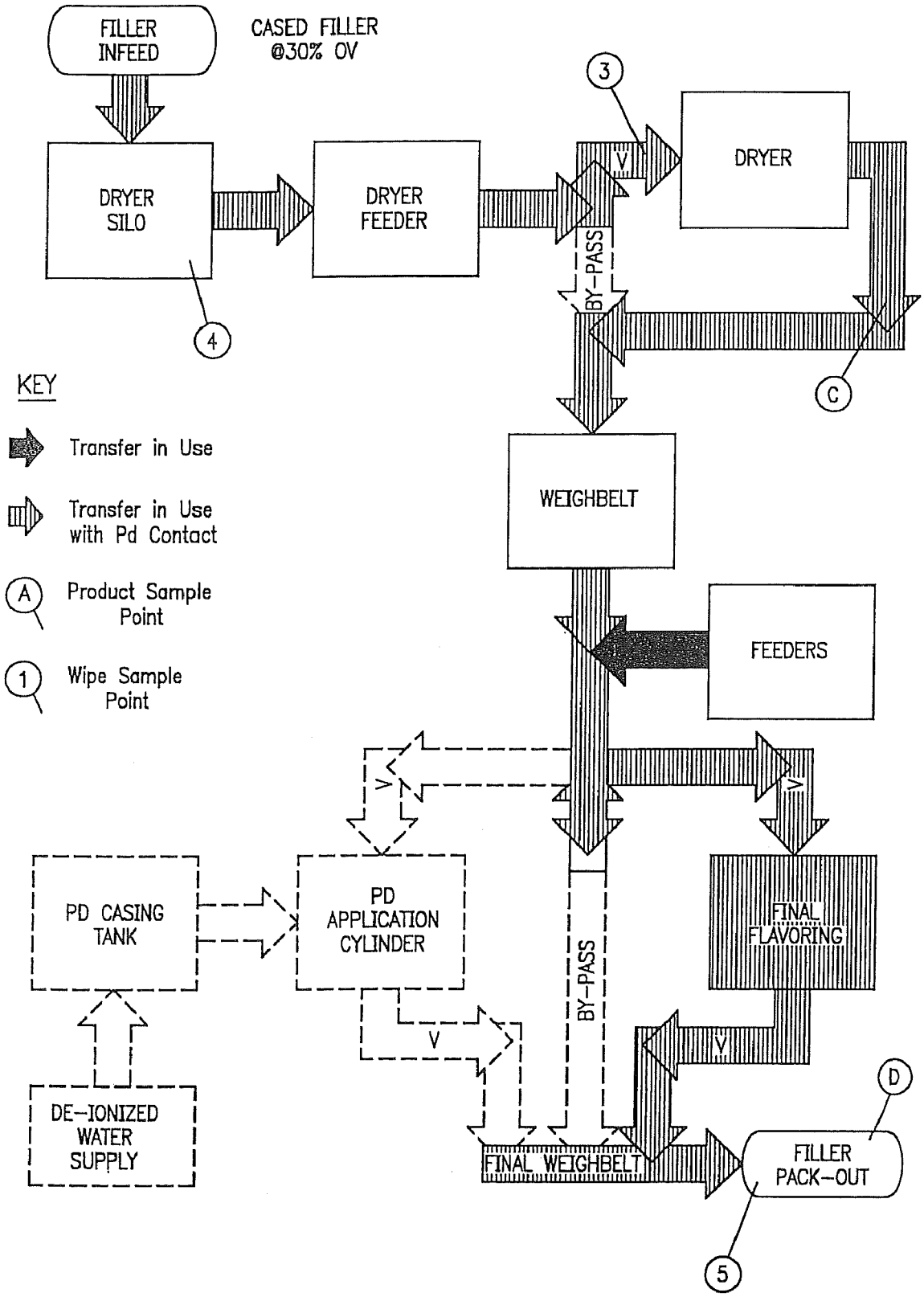
FIG. 5 is an exemplary block diagram for the Drying Train measurement.

FIG. 5 is an exemplary flow diagram for the method of drying train measurement. Once the tobacco filler was sprayed with the palladium solution, it was fed back to be dried and then to have final flavoring and processing completed. Samples were taken at several points in the process as indicated by references A and 1 of FIG. 5. Sample locations C, D refer to the locations where cut filler samples were taken for filler analysis. Sample locations at references 3, 4, 5 refer to locations where wipe samples were taken to have analyzed for palladium levels for purpose of effectiveness before and after cleaning of equipment. The description of casing and drying train measurements is discussed above.

Figure 6:
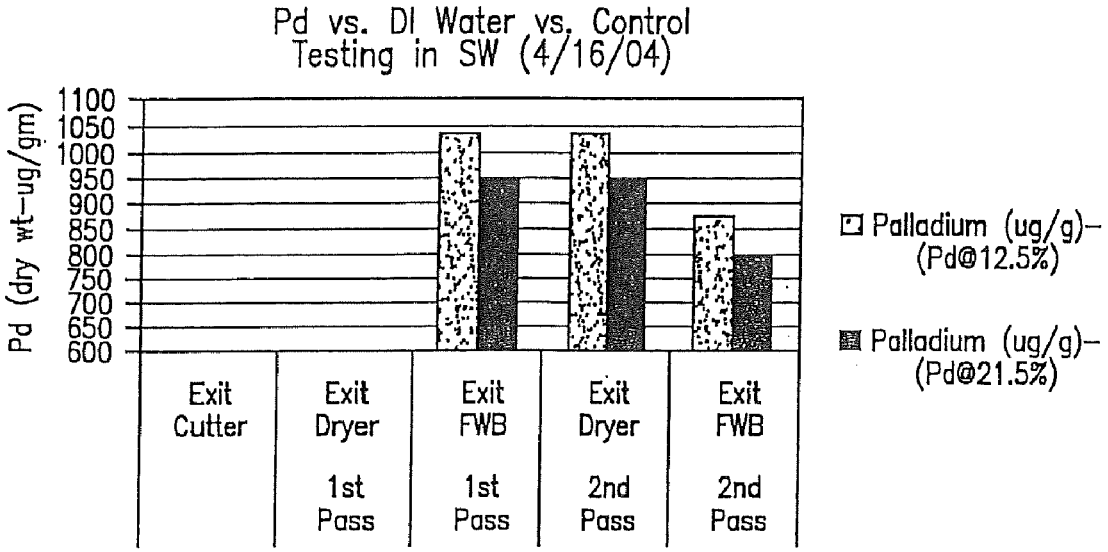
FIG. 6 is test data from the Pd Level testing.
Figure 7:
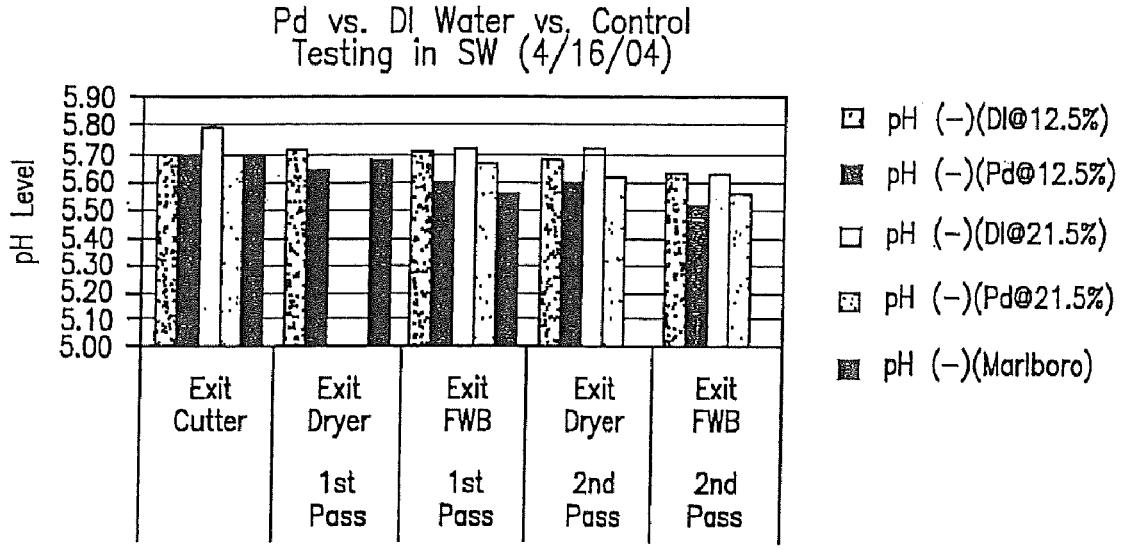
FIG. 7 is test data from the pH Level testing.
Figure 8:
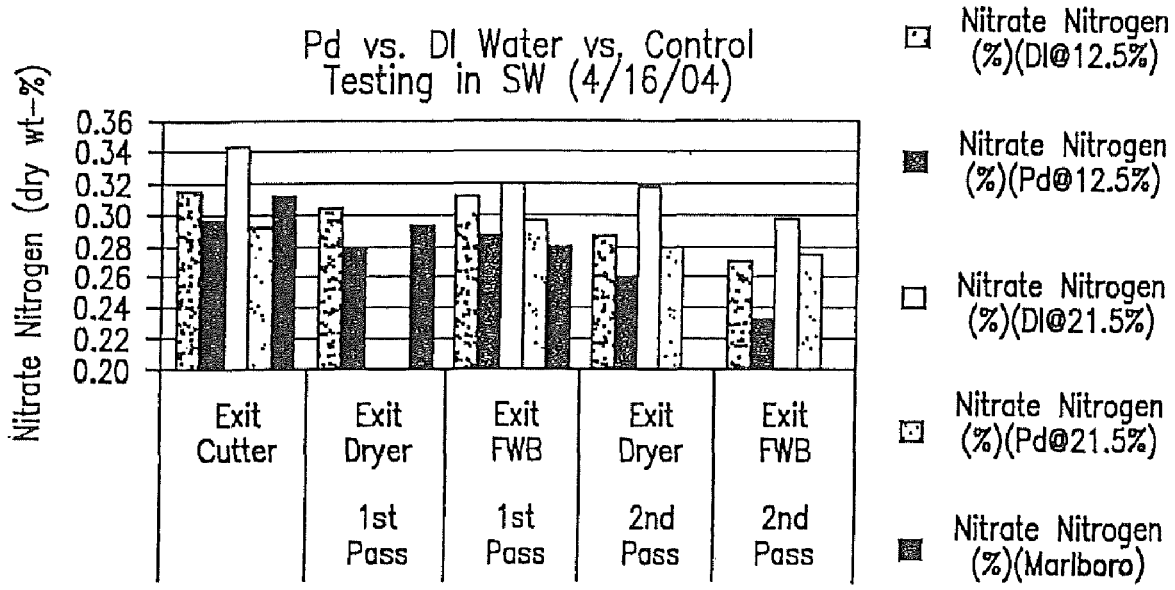
FIG. 8 is test data from the Nitrate Nitrogen testing.

In particular, FIG. 6, FIG. 7 and FIG. 8 address detailed results for Pd level, pH level and Nitrate Nitrogen tests. Overall, test results would help to determine what effect the additional drying step from using a starting OV of 12.5% had as well as the possible effect of palladium on additional processing, casings and flavors. It should also be noted that although the same tobacco was used for each run that the starting levels of some constituents varied greatly. However, in the comparison between the tests the change from exit cutter to exit final Weighbelt was measured and compared. This step allows a true comparison for any changes between tests.

The data in FIG. 6 shows that final filler target of 750 ppm Pd was achieved for the starting OV test of 21.5% (785 ppm), however, was slightly higher for the 12.5% OV test (866 ppm). The reason for the slightly higher level is due to differences in expected OV's exit dryer. However, the results of FIG. 6 show that this did not have a net difference on the overall analysis.

FIG. 7 shows that, although the pH of the palladium salt solution is approximately 3.3, the pH of the palladium salt solution did not seem to have an effect on the pH of the overall filler as compared to the controls using either de-ionized (DI) water or the first standard control test. The final pH of the standard filler was 5.56 while the pH levels for the 12.5% and 21.5% were 5.52 and 5.57, respectively.

FIG. 8 shows the results of the Nitrate Nitrogen tests. For nitrate nitrogen there did not seem to be any difference between the first standard control test run and the run at 21.5%. The run at 12.5% did show a larger decrease in the nitrate nitrogen level than the other tests even though the starting level was identical to the first standard control test run and the other palladium run.

In addition to the results discussed above, it has been determined that there is a point at which adding more palladium may not increase PAH reduction. Further, wipe sample data shows that in order to clean equipment and run another product (i.e., non-palladium) requires extensive cleaning. Thus, most likely a separate line should be used for processing palladium filler.

In a separate test, Metals in Smoke were examined. TABLE 1 below shows the results of these tests. A test was run to determine if the amount of Pd applied to tobacco cut filler affected different smoke constituents. For example, the levels of certain heavy metals are listed below. The only difference between the control and test conditions is the palladium that is applied. The control included only spraying de-ionized water not a palladium solution in order to that all tests achieved a similar final wetted OV for the tobacco cut filler.

TABLE 1

METALS IN SMOKE TEST RESULTS

| | Control | 500 PPM | 600 | 750 | 1000 PPM |
|---|---|---|---|---|---|
| Arsenic | 2.4 | 1.6 | 1.4 | 1.4 | 1.3 |
| Cadmium (ng/cigt) | 21.8 | 14.8 | 12.5 | 12.5 | 10.3 |
| Lead (ng/cigt) | 7.2 | <3.30 | <3.30 | <3.30 | <3.30 |

Reductions in Arsenic ranged from 33 to 46%. Cadmium ranged from 32 to 53%. Lead was reduced by at least 56% (LOD was limited to 3.30 ng/cigt).

The foregoing description illustrates and describes the present invention. Additionally, the disclosure shows and describes only the preferred embodiments of the invention, but as mentioned above, it is to be understood that the invention is capable of use in various other combinations, modifications, and environments and is capable of changes or modifications within the scope of the inventive concept as expressed herein, commensurate with the above teachings and/or skill or knowledge of the relevant art. The embodiments described hereinabove are further intended to explain best modes known of practicing the invention and to enable others skilled in the art to utilize the invention in such, or other embodiments and with the various modifications required by the particular applications or uses of the invention. Accordingly, the description is not intended to limit the invention to the form or application disclosed herein. Also, it is intended that the appended claims be construed to include alternative embodiments.

What is claimed is:

1. An apparatus for applying a palladium (Pd) salt solution comprising:

a cutter unit;

a feeder unit;

a Pd Salt Solution Preparation Unit;

a Pd Application Cylinder configured to apply prepared Pd Salt;

a dryer; and a Final Flavoring cylinder, wherein the cutter unit receives and prepares tobacco cut filler, the feeder unit receives and feeds the tobacco cut filler from the cutter unit to the Pd Salt Solution Application Cylinder, the Pd Salt Solution Application Cylinder receives and sprays the tobacco cut filler with a metered Pd Salt solution from the Pd Salt Solution Preparation unit, the dryer unit receives and dries sprayed filler from the Pd Application Cylinder, and the Final Flavoring Cylinder receives dried filler from the dryer unit.

2. The apparatus of claim 1, wherein the Pd Salt Solution Preparation unit further comprises: a Pd Salt Solution Source;

a Pd Concentration Metering Unit;

a De-ionized Water Source;

a De-ionized Water Metering Unit;

a Pd Salt Solution Tank; and a concentrated Pd Salt Solution Metering Unit, wherein the Pd Concentration Metering Unit and the De-ionized Water Metering Unit are configured to provide metered amounts of each the Pd Salt Solution Source and the De-ionized Water Source, respectively, to the Pd Solution Tank, and the concentrated Pd Salt Solution Metering Unit is configured to provide the metered Pd Salt solution to the Pd Application Cylinder.

3. A method for applying the palladium salt solution comprising:

preparing tobacco cut filler;

feeding the tobacco cut filler to a Pd Application Cylinder;

metering a predetermined amount of Pd Salt solution from a Pd Salt Solution tank;

spraying the tobacco cut filler with the metered amount of Pd Salt Solution in a Pd Application Cylinder;

drying the sprayed tobacco cut filler in a drying unit; and processing the dried tobacco cut filler.

4. The method of claim 3, wherein Pd Salt is in the form of tetracholorpalladate with salts of at least one of potassium, ammonia and sodium.

5. The method of claim 4, wherein the metered Pd Salt Solution is applied to tobacco filler in a range from 12% oven volatiles (OVs) up to and including 45% OV.

6. The method of claim 5, wherein the concentration for Pd Salt Solution relative to tobacco weight is in a range between 0.01% and 0.15%.

7. The method of claim 6, wherein a predetermined ratio of chlorine (Cl)-to-palladium (Pd) maintains a proper solution pH.

8. The method of claim 7, wherein the metered Pd Salt Solution provides a palladium solubility of >99%.

* * * * *